United States Patent [19]

Maser

[11] Patent Number: 4,683,360

[45] Date of Patent: Jul. 28, 1987

[54] MEMBRANE SWITCH COMBINED WITH ELECTROLUMINESCENT LAMP PANEL

[75] Inventor: Thomas L. Maser, Mequon, Wis.

[73] Assignee: W. H. Brady Co., Milwaukee, Wis.

[21] Appl. No.: 861,485

[22] Filed: May 9, 1986

[51] Int. Cl.[4] ..... H01H 9/16

[52] U.S. Cl. ..... 200/314; 200/317; 200/5 A; 200/159 B

[58] Field of Search ..... 200/317, 314, 313, 5 A, 200/310, 308, 159 B

[56] References Cited

U.S. PATENT DOCUMENTS

| | | | |
|---|---|---|---|
| 4,060,703 | 11/1977 | Everett, Jr. | 200/5 A |
| 4,075,449 | 2/1978 | Yagi et al. | 200/315 |
| 4,320,268 | 3/1982 | Brown | 200/5 A |
| 4,532,395 | 7/1985 | Zukowski | 200/314 |

FOREIGN PATENT DOCUMENTS

| | | | |
|---|---|---|---|
| 0017580 | 10/1980 | European Pat. Off. | 200/314 |
| 2833304 | 2/1979 | Fed. Rep. of Germany | 200/314 |
| 3517551 | 12/1985 | Fed. Rep. of Germany | 200/310 |

OTHER PUBLICATIONS

I.B.M., Technical Disclosure Bulletin, vol. 13, No. 3, 8/1970.

*Primary Examiner*—Stephen Marcus
*Assistant Examiner*—Ernest G. Cusick
*Attorney, Agent, or Firm*—Quarles & Brady

[57] ABSTRACT

An assembly combining a membrane switch and an electroluminescent lamp panel in which the lamp panel is attached to a circuit layer of the membrane switch.

5 Claims, 8 Drawing Figures

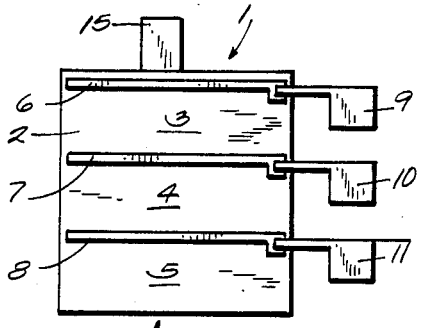
Fig. 1
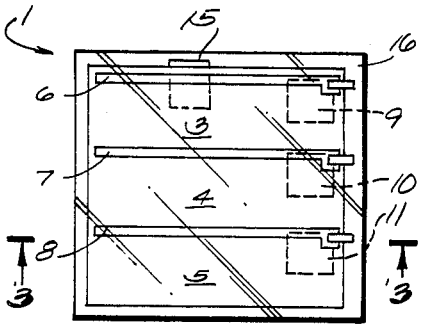
Fig. 2
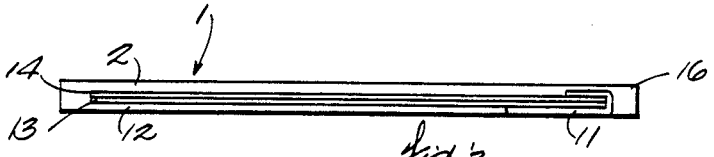
Fig. 3
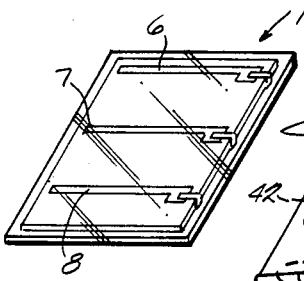
Fig. 4
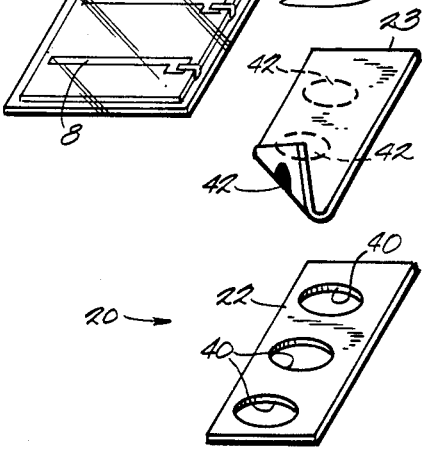
Fig. 5
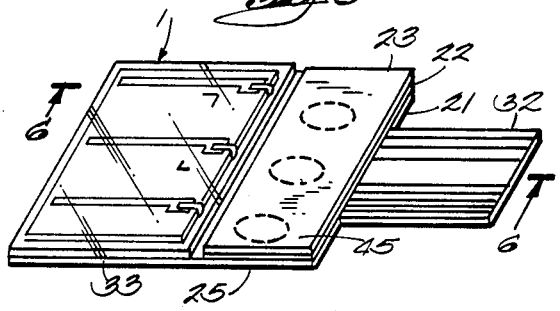
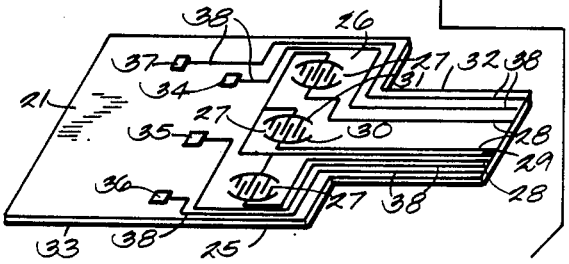

MEMBRANE SWITCH COMBINED WITH ELECTROLUMINESCENT LAMP PANEL

TECHNICAL FIELD

The present invention relates to the field of membrane switches that further include an electroluminescent lamp panel to form a combination switch-lamp structure.

BACKGROUND

The term "membrane switch" as used herein refers to electrical switches constructed of at least two panels of plastic film spaced from one another so that a surface of one film faces a surface of the other film. The two facing surfaces each carry a conductive pattern, generally printed with a conductive ink or applied onto the films by vacuum metalizing techniques. The conductive patterns include contacts juxtaposed to form one or more switch cells; the conductive pattern on at least one of the film panels includes conductive tracks leading from the contacts of the pattern to an edge of the film panel for connection to external circuitry. The two panels are spaced from each other by a spacer layer between the two facing surfaces, which can be a patterned adhesive layer or a die-cut plastic film, having apertures positioned between contacts of the conductive pattern on the surface of one film and contacts of the conductive pattern on the facing surface of the other film. A contact on one film and a contact on the other film electrically registered therewith form a switch cell; most membrane switches are made with a plurality of switch cells arranged in rows and columns.

The term "electroluminescent lamp panel" as used herein refers to lamp elements comprising a base electrode spaced from a transparent electrode together with a dielectric layer and a phosphorescent layer between the two electrodes. Two types of electroluminescent lamp panels are known in the art, "foil" and "printed" which differ from one another by the nature of the base electrode. In a foil electroluminescent lamp, the base electrode is a thin aluminum foil layer whereas in a printed electroluminescent lamp the base electrode is a printed layer of conductive ink. Conductive leads extend from the base and transparent electrodes of the lamp panel. When AC voltage is applied across the leads, the current induced between the base and transparent electrodes causes the phosphorescent layer to emit light, a phenomenon known as luminescence. An electroluminescent lamp can be thought of as a light emitting capacitor. The light is visible through the transparent electrode, and various chemicals are known in the art that can be employed for the phosphorescent layer to provide lights of various colors. The lamp panels can include one or a plurality of individual electroluminescent lamps.

Membrane switches find widespread use in installations in which a sealed or protected switch or operating panel is desirable. For example, they are employed in equipment which requires manual data entry such as computer keyboards, terminals, cash registers and the like. Also, membrane switches are widely used as a control or instrument panel for appliances such as washers, microwave ovens, industrial controls, copy machines, and the like, in which finger touch micro-motion actuation is a useful feature.

There are numerous uses of membrane switches in which it is desirable to include lighting as part of the switch panel. The lighting may be used for general background lighting of the membrane switch panel or it may be used to provide a visual indication when a particular switch cell of a membrane switch panel is activated. Electroluminescent lamp panels are a useful source of light for use in combination with a membrane switch panel since they can provide attractive, effective lighting in various colors and they can include individual or discrete lamp segments.

The typical structures disclosed in prior patents that combine an electroluminescent light panel and membrane switch layers generally provide for lamp panels that are separate from the membrane switch elements, most often in a layered construction in which the lamp panel is placed above or superimposed upon the membrane switch elements. In particular, this type of construction is disclosed in U.S. Pat. Nos. 4,060,703, 4,320,268 and 4,532,395. Another feature of the prior art constructions illustrated in these patents is that the leads associated with the electroluminescent lamp panels are independent of leads associated with the membrane switch elements. It is my belief that the prior art constructions are cumbersome and expensive to manufacture; accordingly, one of the principal objects of my present invention is to provide a cost effective system for combining a membrane switch and an electroluminescent light panel in a composite assembly. Another main object is to provide a membrane switch-electroluminescent lamp panel assembly in which circuitry for both the switch and the lamp panel can be arranged to lead onto a single tail of the assembly for connection to external circuitry. Another main object is to provide a membrane switch-electroluminescent light panel assembly in which leads to the switch and leads to the lamp panel can be on separate tails if so desired, and still provide a convenient system for accommodating the electrical leads to the two elements of the assembly. Other objects of this invention will become apparent from the detailed description which follows.

SUMMARY OF THE INVENTION

The present invention provides a new combination of a membrane switch and an electroluminescent lamp panel in which (1) the membrane switch includes spaced circuit layers with conductive circuits on facing surfaces thereof and at least one tail portion, (2) the electroluminescent lamp panel has conductive leads along at least one surface thereof, and (3) the lamp panel is attached to at least one of the circuit layers of the membrane switch with the conductive leads thereof electrically connected to conductive pads on the circuit layer.

DESCRIPTION OF THE DRAWINGS

The present invention is fully described hereinafter by reference to the accompanying drawings, in which:

FIG. 1 is a plan view of an electroluminescent lamp panel of the type employed with the assembly of the present invention illustrated in an intermediate stage of its manufacture;

FIG. 2 is a plan view of the lamp panel of FIG. 1 in its completed form;

FIG. 3 is a sectional view of the lamp panel as illustrated in FIG. 2;

FIG. 4 is an exploded view of a membrane switch-electroluminescent lamp panel assembly of the present invention;

FIG. 5 is a perspective view of the assembly of FIG. 4 in its final condition;

DESCRIPTION OF THE PREFERRED EMBODIMENTS

Figure 6:
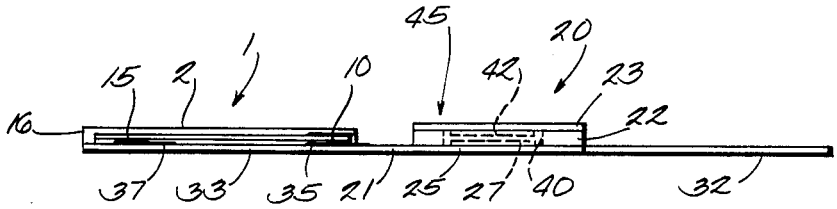
FIG. 6 is a sectional view of the assembly illustrated in FIGS. 4 and 5.

The term "electroluminescent" is often abbreviated as "EL" in the following detailed description of several embodiments of the present invention.

FIG. 1 is a plan view of a foil-type electroluminescent lamp panel 1 at an intermediate stage of manufacture, viewed from the surface of transparent electrode 2 of the panel. The EL lamp panel 1 is divided into three individual EL lamps 3, 4 and 5. The panel includes a conductive bus bar 6 in electrical contact with EL lamp 3, conductive bus bar 7 in electrical contact with EL lamp 4 and conductive bus bar 8 in electrical contact with EL lamp 5. Conductive leads 9, 10 and 11, which are of copper in the exemplary lamp panel, are connected to and extend from bus bars 6, 7 and 8 respectively.

The EL lamp panel 1 also includes other elements found in a foil EL panel that are not visible in FIG. 1 but are shown in the sectional view of FIG. 3 comprising a base electrode 12 of aluminum foil spaced from the transparent electrode 2, a dielectric layer 13 and a phosphorescent layer 14 between the electrodes 2 and 12. Returning to FIG. 1, conductive lead 15 is connected to and extends from base electrode 12 of the EL lamp panel.

FIG. 2 is a plan view of EL lamp panel 1 after final manufacture wherein leads 9–11 and 15 have been folded to lie along the rear surface of the panel as viewed in the drawings and a transparent envelope 16 of plastic has been cast about the entire panel to seal and insulate the functional elements of the panel. As shown in FIG. 3, the thickness of the envelope 16 is such that lead 11, and also leads 9, 10 and 15, are flush with the outer surface of the envelope 16 along the rear of the panel 1 so as to have an exposed surface along the outer surface of the envelope to which electrical contact can be made.

FIG. 4 illustrates the elements of an assembly 20 of a membrane switch and EL panel combination as a first embodiment of the present invention. The assembly 20 includes a first circuit layer 21, a spacer layer 22, a second circuit layer 23 and EL lamp panel 1.

Circuit layer 21 includes a first portion 25 that carries a conductive circuit 26 having a pattern comprising a set of conductive contacts 27, a plurality of conductive tracks 28 and a conductive track 29. The contacts 27 are of known construction in the illustrative embodiment and are formed of two separate sections 30 and 31, each including a curved portion and rectilinear fingers extending therefrom with the fingers of a section 30 being interdigitated with the fingers of a section 31 of each contact. A conductive track 28 leads from each section 30 of each contact 27 and extends to the end of a tail 32 formed as a portion of circuit layer 21, there being one track 28 for each contact 27. The sections 31 of each contact 27 are connected to a single common conductive track 29 which also extends to the end of tail 32.

First circuit layer 21 includes a second portion 33 that is adjacent to and alongside first portion 25, the first and second portions and the tail being shown as integral with one another. Conductive pads 34, 35, 36 and 37 are carried on the second portion 33 of the first circuit layer. Each pad 34–37 is connected to a conductive track 38, there being one track 38 for each pad, which leads across the first portion 25 of the first circuit layer to the end of tail 32. The conductive pads 34–37 are arranged in a pattern that can be registered with the spacing between leads 9–11 and 15 of EL panel 1.

The spacer 22, which can be a die-cut piece of plastic film with adhesive on its upper and lower surfaces or a layer of patterned adhesive, includes apertures 40 that extend through the layer. There is one aperture 40 aligned with each contact 27 of the circuit on layer 21.

Second circuit layer 23 also includes a conductive circuit on its lower surface facing the circuit layer 21. The conductive circuit on the bottom of layer 23 in the illustrative embodiment comprises a series of three spaced conductive contacts 42. There is a contact 42 on the second circuit layer 23 that is to be electrically registered with each contact 27 of the circuit 26 carried on the first circuit layer 21.

FIGS. 5 and 6 illustrate the assembly 20 of FIG. 4 in its final condition. Second circuit layer 23 is secured to spacer layer 22 which in turn is secured to first circuit layer 21 along the first portion 25 thereof. This provides a membrane switch indicated by the general reference numeral 45 wherein contacts 42 on the bottom surface of layer 23 facing layer 21 are spaced from and electrically registered with contacts 27 carried on the upper surface of 21, i.e. the surface facing layer 23. Each pair of spaced contacts 42 and 27 of the respective circuit layers forms a switch cell, there being three switch cells in the exemplary construction 20. Further, EL panel 1 is attached to second portion 33 of the first circuit layer 21, which attachment can be accomplished by any suitable means preferably with adhesive such as a pressure sensitive or thermally activated adhesive. The EL panel 1 is positioned on the first circuit layer 21 in such manner that leads 9–11 and 15 thereof will be in electrical contact with conductive pads 34–37; specifically, lead 9 of EL panel 1 is to be in electrical contact with conductive pad 34, lead 10 with conductive pad 35, lead 11 with conductive pad 36 and lead 15 with conductive pad 37. Electrical connection between the leads 9–11, 15 and the conductive pads 34–37 can be accomplished in any manner appropriate to obtaining electrical connection therebetween; useful systems include joining the leads and pads with conductive adhesives such as a conductive epoxy material, or using mechanical means to form electrical connections such as a metal spring or physical such as with metal crimping. As best indicated in FIG. 5, conductive tracks 28 and 29 which are to be connected to external circuitry for actuation of the membrane switch 45 of assembly 20 lead to the end of tail 32 at which they can be connected to suitable sensing drive circuitry in the usual manner. Also, the conductive tracks 38 which are used to supply AC power to EL panel 1 for illumination of lamps 3–5 thereof also extend to the end of tail 32 so that they can be connected to a suitable source of AC power and other electronic circuitry which may be utilized to illuminate the lamps. The EL panel 1 is secured to the first circuit layer 21 with the transparent electrode 2 thereof facing outwardly from the circuit layers as shown in FIG. 5 so that lamps 3–5 will be visible when activated.

A selected switch cell of membrane switch 45 of assembly 20 can be activated by an operator pressing downwardly along the top surface of second circuit layer 23 at the selected switch cell so that a contact 42 makes electrical contact with a contact 27 on the first circuit layer. The switch cells of the membrane switch 45 can be used to illuminate individual EL lamps 3–5 of the assembly by being connected to suitable control circuitry that in turn will actuate the electronics associated with the lamp panel or the switch cells can be connected to other external circuitry for activation independently of the EL lamps.

Figure 7:
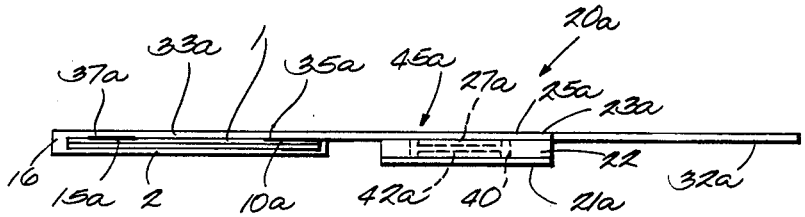
FIG. 7 is a sectional view similar to FIG. 6 of a second embodiment of a membrane switch-electroluminescent lamp panel assembly according to the present invention.

FIG. 7 illustrates a second embodiment 20*a* of a membrane switch-EL lamp panel combination according to the present invention. In assembly 20*a*, EL lamp panel 1 is attached to second circuit layer 23*a* instead of the first circuit layer as in assembly 20 of FIGS. 5 and 6 and layer 23*a* carries the circuitry to be associated with the lamp panel. The several elements of assembly 20*a* of FIG. 7 are the same as corresponding elements of the first embodiment and are identified by the same reference numeral followed by the suffix "a" in FIG. 7. Thus tail 32*a* extends from second circuit layer 23*a*.

Figure 8:
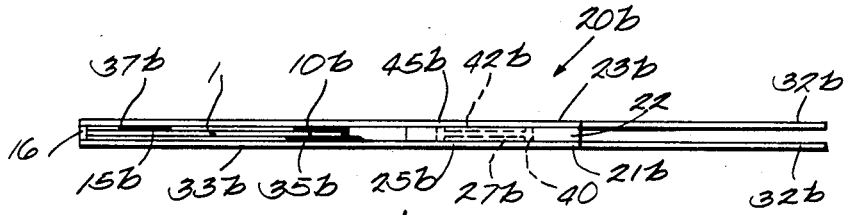
FIG. 8 is a sectional view similar to FIG. 6 of a third embodiment of an assembly of the present invention.

FIG. 8 is a sectional view of a third embodiment of a membrane switch-EL lamp panel combination in accordance with the present invention. In assembly 20*b*, EL lamp panel 1 includes lead 10*b* along its lower surface and lead 15*b* along its upper surface. First circuit layer 21*b* and second circuit layer 23*b* each carry conductive circuits on their facing surfaces. Lead 15*b* will be in electrical contact with conductive pad 37*b* on the underside of second circuit layer 23*b* and lead 10*b* will be in contact with conductive pad 35*b* on the surface of first circuit layer 21*b* facing the EL panel 1. A tail 32*b* can extend from each of the circuit layers 21*b* and 23*b* in the assembly 20*b* if so desired. The transparent electrode(s) of the EL lamp panel 1 can be behind a window of layer 21*b* or 23*b* so that colored light will be visible through the window when the panel is activated or layer 21*b* or 23*b* can be transparent so that colored light from the panel will be visible. The construction of assembly 20*b* can facilitate connection of the assembly to certain types of equipment and illustrates that a combination switch-EL panel assembly of the present invention can be made in various configurations so as to be adaptable to many types of installation requirements.

In each of the preceding embodiments, the first circuit layer and second circuit layer can be made of any non-conductive flexible pastic film suitable for membrane switches. Polyester films, such as polyethylene terephthalate films, are the most commonly used materials. Also, however, polycarbonate films, polyimide films, nylon films and polysulfone films can be used, as well as others such as polyolefin and polyvinyl chloride films. The plastic film material selected for the circuit layers can be in the range of about 1 to 20 mils thick, or thicker if so desired, with 5 mil thick films being generally appropriate for most membrane switch applications. Further, the first and second circuit layers can be of the same plastic film material, or of dissimilar plastic film materials. The conductive circuits on the circuit layers can be printed with conductive inks, of which many types are well known in the art and commercially available, that may comprise a conductive metal such as silver, gold, copper, etc. in a suitable binder. Also, however, the conductive circuits can be applied to the surfaces of circuit layers by vacuum deposition of aluminum or other appropriate conductive metal onto the plastic film. In all respects, the membrane switch-EL panel assemblies 20, 20*a* and 20*b* described above can be produced by the manufacturing techniques typically used in the membrane switch art and with materials typically used in such art.

There has thus been described several embodiments of a new combination of an EL lamp panel and a membrane switch. The assemblies described above provide a combination of these elements which can be manufactured at lower cost than prior art assemblies incorporating membrane switch and EL lamp elements. Also, a compact package is provided with the assemblies of the present invention that is capable of being manufactured in various configurations, to thereby offer the potential of extending the use of membrane switches and EL panels in many types of equipment. The new constructions of the present invention also offer the opportunity to have electrical circuitry associated with the membrane switch and electrical circuitry associated with the EL lamp panel all brought out to a single tail for connection to external electronics, such as illustrated with assemblies 20 and 20*a*. This feature provides for simple and convenient connection of both a membrane switch and an EL lamp panel to external circuitry. Also, however, assemblies of this invention can include separate tails, with one tail carrying circuitry for the switch portion and the other tail carrying circuitry for the EL lamp portion, such as illustrated by assembly 20*b* above. This latter feature gives the switch designer a great deal of flexibility in providing the type of membrane switch-EL lamp construction that will be most appropriate for their particular piece of equipment.

The present invention has been described above by reference to certain specific embodiments. For example, the membrane switch portion of the exemplary assemblies is shown as including three switch cells; the membrane switch portion is to have at least one switch cell, but may have two or more or as many as required for a particular installation. The EL lamp panel is shown as including three individual EL lamps in the exemplary assemblies; the panel is to have at least one EL lamp but may have two or more or as many as required for a particular installation. It is to be understood that other changes to the described embodiments can be made by those of ordinary skill in the art that will remain within the spirit and scope of the present invention and all such changes are intended to be encompassed within the scope of the appended claims.

I claim:

1. A membrane switch-electroluminescent lamp panel assembly comprising, in combination:

(1) a membrane switch comprising a first circuit layer and a second circuit layer spaced from one another, a conductive circuit including at least one contact on a surface of the first circuit layer and a conductive circuit including at least one contact on a surface of the second circuit layer, the circuit layers being arranged with their surface carrying the conductive circuits facing one another, conductive tracks leading from the conductive circuit on at least one of said circuit layers to the end of a tail portion extending from such circuit layer, said conductive circuits forming a membrane switch with at least one switch cell comprising spaced contacts;

(2) an electroluminescent lamp panel including spaced transparent and base electrodes with dielectric and phosphorescent layers therebetween surrounded by an envelope of insulating plastic, a conductive lead from each transparent electrode of the lamp panel arranged along a surface of the envelope and a conductive lead from the base electrode of the lamp panel arranged along a surface of the envelope; and wherein (3) the electroluminescent lamp panel is attached to the first circuit layer or the second circuit layer with each conductive lead of the electroluminescent lamp panel electrically connected to a conductive pad on the circuit layer, and a conductive track on such circuit layer leading from each conductive pad to a tail portion for connection to electrical circuitry.

2. A membrane switch-electroluminescent lamp panel assembly according to claim 1, wherein: the circuit layer to which the lamp panel is attached includes a first portion carrying the conductive circuit for the membrane switch and a second portion alongside the first portion carrying the conductive pads, and the lamp panel is attached to the second portion of said circuit layer.

3. A membrane switch-electroluminescent lamp panel assembly according to claim 1, wherein: the circuit layer to which the lamp panel is attached is a lower layer of the assembly.

4. A membrane switch-electroluminescent lamp panel assembly according to claim 1, wherein: the circuit layer to which the lamp panel is attached is an upper layer of the assembly.

5. A membrane switch-electroluminescent lamp panel assembly according to claim 1, wherein: both the first circuit layer and the second circuit layer each include (1) a first portion carrying a conductive circuit for the membrane switch, and (2) a second portion alongside the first portion and carrying at least one conductive pad, and the lamp panel is attached to both the first and second circuit layers along the second portion of each circuit layer with its conductive leads electrically connected to conductive pads on each circuit layer.

* * * * *